United States Patent [19]

Fischer

[11] Patent Number: 4,749,918

[45] Date of Patent: Jun. 7, 1988

[54] SYSTEM FOR CORRECTING FOR COLOR IMPURITIES DUE TO HORIZONTAL BEAM LANDING ERRORS IN FLAT PANEL DISPLAY DEVICES

[75] Inventor: John T. Fischer, Princeton, N.J.

[73] Assignee: RCA Licensing Corporation, Princeton, N.J.

[21] Appl. No.: 328,611

[22] Filed: Dec. 8, 1981

[51] Int. Cl.[4] ..... H01J 29/70; H01J 29/56

[52] U.S. Cl. ..... 315/368; 315/366; 315/370

[58] Field of Search ..... 315/10, 370, 367, 366, 315/368, 371, 307; 358/67, 69, 10, 65; 313/422, 412; 335/212, 210

[56] References Cited

U.S. PATENT DOCUMENTS

| | | | |
|---|---|---|---|
| 4,099,092 | 7/1978 | Bristow | 315/10 |
| 4,117,368 | 10/1978 | Marlowe et al. | 313/422 |
| 4,126,814 | 11/1978 | Marlowe | 315/307 |
| 4,131,823 | 12/1978 | Credelle | 313/422 |
| 4,305,022 | 12/1981 | Mitamura et al. | 315/370 |
| 4,354,143 | 10/1982 | Judd | 315/367 |
| 4,376,260 | 3/1983 | Russell | 315/366 |

*Primary Examiner*—Theodore M. Blum
*Assistant Examiner*—John B. Sotomayor
*Attorney, Agent, or Firm*—E. M. Whitacre; D. H. Irlbeck; L. L. Hallacher

[57] ABSTRACT

A flat panel display device is divided into channels and includes deflection electrodes for scanning electron beams horizontally across the channels. Convergence electrodes are voltage biased to converge the electron beams at points along the transverse line scanned by the electron beams. A compensation voltage generator provides compensation voltages to compensate for horizontal landing errors of the electron beams.

2 Claims, 4 Drawing Sheets

SYSTEM FOR CORRECTING FOR COLOR IMPURITIES DUE TO HORIZONTAL BEAM LANDING ERRORS IN FLAT PANEL DISPLAY DEVICES

BACKGROUND OF THE INVENTION

This invention relates generally to modular flat panel display devices and particularly to a system for compensating for color impurities caused by horizontal beam landing errors in such devices.

A modular flat panel display device in which the instant invention can be utilized is described in U.S. Pat. No. 4,117,368 issued to F. J. Marlowe, et al. The Marlowe et al. device consists of an evacuated envelope which is divided into channels by a plurality of vanes. Each of the channels include guide meshes for propagating electron beams along the lengths of the channels. When a particular line of the visual display is to be produced, the electron beams are ejected from the guide meshes and travel toward the display screen. The vanes support deflection electrodes which are biased with varying deflection potentials. These deflection potentials cause the electrons traveling from the guide meshes to the display screen to be scanned transversely across the channels. The electron beams of all the channels are simultaneously ejected from between the guide meshes so that a portion of the same horizontal line of the visual display is simultaneously generated transversely across each of the channels.

U.S. Pat. No. 4,131,823 issued to T. L. Credelle shows a system for converging the electron beams in a flat panel display device of the type described in the Marlowe et al. patent. In the Credelle device, deflection electrodes of the type disclosed in the Marlowe et al. patent, are arranged on both sides of the internal support walls and extend the longitudinal dimension of the channels. Arranged on both sides of the deflection electrodes are guard, or convergence, electrodes which also extend along the longitudinal dimension of the channels. Accordingly, electron beams which are traveling from the beam propagation meshes toward the phosphor screen sequentially pass the first convergence electrode, the deflection electrode, and the second convergence electrode. The convergence electrodes are voltage biased to cause the electron beams to converge at the shadow mask which is arranged parallel to and spaced from the phosphor screen. The shadow mask contains apertures through which the electron beams must pass in order to strike the phosphor screen. Because the three electron beams pass through the apertures at different angles, each of the three beams strikes a different one of the phosphors so that different colors of light are emitted. The shadow mask therefore serves as a color selection electrode. The convergence potentials on the convergence electrodes cause all the electron beams to converge at the same point on the shadow mask and the deflection potentials on the deflection electrodes cause the convergence point of the three beams to transversely scan across the channels. Accordingly, the combined effect of the deflection potentials and the convergence potentials is that of causing the electron beams to converge at points along traverse lines across the shadow mask. The three beams pass through the shadow mask apertures at different angles whereby each electron beam strikes a different color phosphor and a color display is produced. Typically, in flat panel display devices the transverse and longitudinal dimensions are referred to as the horizontal and vertical dimensions respectively. These designations are adopted hereinafter.

The Marlowe and Credelle devices operate in the manner intended; however, minor structural variations in the display device can cause the electron beams to land at horizontal positions which are different from those intended. Because the electron beams are horizontally displaced, the beams pass through the shadow mask apertures at improper angles and the beams strike a phosphor of a color different from that intended. The instant invention overcomes this disadvantage by the provision of a system for providing voltages which compensate for horizontal beam landing errors to thereby substantially reduce or eliminate the color impurities which result from such landing errors.

SUMMARY OF THE INVENTION

A display device having substantially flat, parallel spaced front and back walls includes spaced substantially parallel support walls extending between the front and back walls to divide the device into a plurality of channels. An electron source directs electrons into the channels as electron beams. Beam guides in each of the channels propagate the electron beams longitudinally along the channels until the electron beams are extracted from propagation along the channels and travel toward a phosphor screen on the front wall. The electron beams are transversely scanned across the channels by deflection voltages, and are converged by convergence voltages toward points along lines which are transverse of the channels and spaced from the phosphor screen. Varying compensation voltages are added to the convergence voltages to compensate for beam landing errors along the transverse lines to reduce color impurities caused by the landing errors.

DETAILED DESCRIPTION OF THE PREFERRED EMBODIMENT

Figure 1:
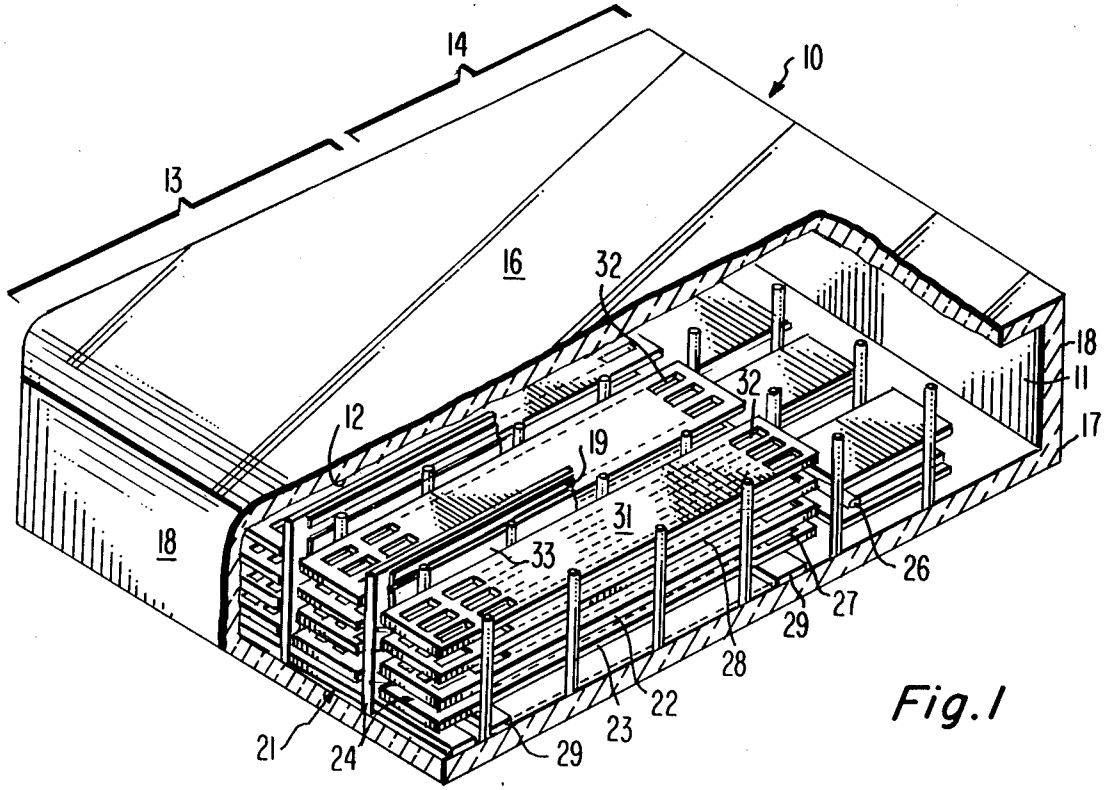
FIG. 1 is a simplified perspective view, partially broken away, showing the major components of a flat panel display device incorporating the preferred embodiment.

FIG. 1 shows a flat panel display device 10 which incorporates the preferred embodiment. The display device 10 includes an evacuated envelope 11 having a display section 13 and an electron gun section 14. The envelope 11 includes a frontwall 16 and a baseplate 17 held in a spaced parallel relationship by sidewalls 18. A display screen 12 is positioned along the frontwall 16 and gives a visual output when struck by electrons.

A plurality of spaced parallel support vanes 19 are arranged between the frontwall 16 and the baseplate 17. The support vanes 19 provide the desired internal support against external atmospheric pressure and divide the envelope 11 into a plurality of channels 21. Each of the channels 21 encloses a pair of spaced parallel beam guide meshes 22 and 23 extending transversely, or horizontally, across the channels and longitudinally, or vertically, along the channels from the gun section 14 to the opposite sidewall 18. A cathode 26 is arranged to emit electrons into the spaces 24 between the guide mesh pairs. The guide meshes 22 and 23 include apertures 27 which are arranged in columns longitudinally along the channels 21 and in rows transversely across the channels. A focus mesh 28 is spaced above the upper guide mesh 22 in a parallel relationship therewith. A plurality of extraction electrodes 29 are arranged along the baseplate 17 to extend transversely across the channels 21 the full width of the display device 10. The extraction electrodes 29 are arranged directly beneath the rows of apertures 27 in the guide meshes 22 and 23. Appropriate biasing voltages are applied to the focus mesh 28 and the extraction electrodes 29 to cause the electrons emitted from the cathode 26 to propagate between the guide meshes 22 and 23 in the spaces 24 for the full length of the channels.

An acceleration mesh 31 is arranged in a spaced parallel relation with the focus mesh 28 and contains a plurality of apertures 32 which also are aligned in columns longitudinally of the channels and in rows transversely of the channels. Scanning electrodes 33 are arranged on both sides of the support vanes 19 so that each vane supports a scanning electrode for two adjacent channels.

In operation, the electron beams propagate in the spaces 24 between the guide meshes 22 and 23 until the production of one horizontal line of the visual display requires the beams to be directed toward the screen 12. Extraction of the electron beams from the spaces between the guide meshes is effected by applying a negative voltage to one of the extraction electrodes 29. The negative voltage causes the electron beams to pass through the apertures 27 in the guide meshes and the apertures 32 in the acceleration mesh 31 and the focus mesh 28. The extracted electron beams are horizontally scanned across the channels 21 by the application of varying voltages, such as sawtooth waveforms, to the scanning electrodes 33 on the sides of the support vanes 19. Every channel therefore is horizontally scanned between the two support vanes 19 so that each channel contributes a portion of each horizontal line of the visual display on the faceplate 16.

Figure 2:
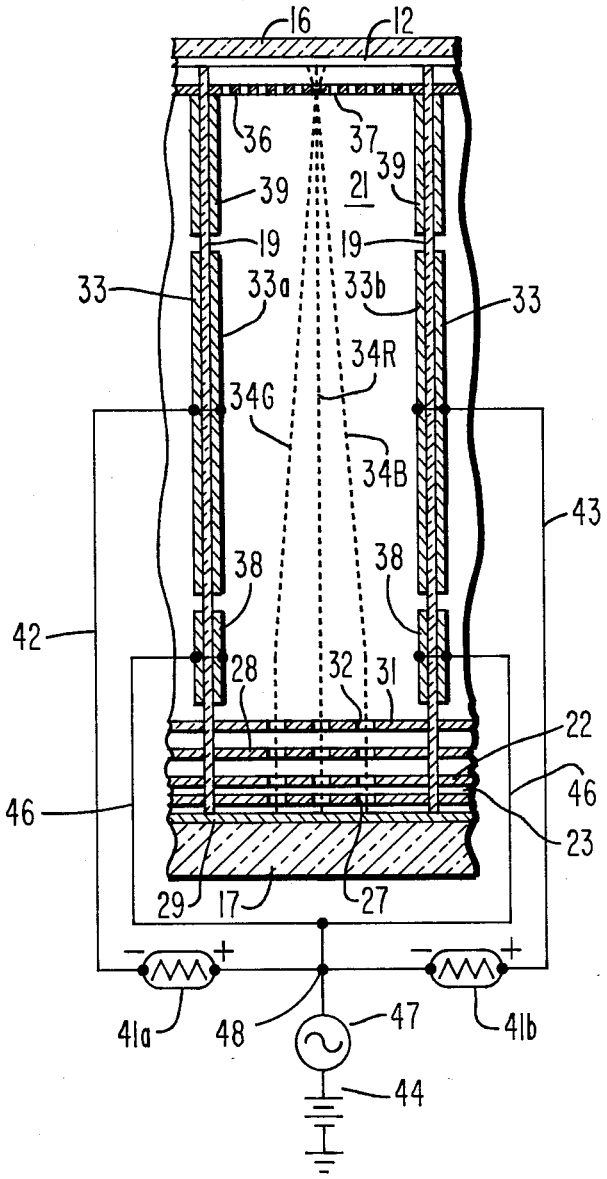
FIG. 2 shows how three electron beams are converged at the screen of a flat panel display device to strike phosphors of the desired colors and how compensation voltages are applied to reduce the color impurities caused by horizontal landing errors of electron beams on the display screen.

FIG. 2 is a cross section showing of one channel of a flat panel display device in which three electron beams 34G, 34R and 34B have been extracted from propagation between the guide meshes 22 and 23 to travel toward the screen 16. Arranged parallel to and spaced from the phosphor screen 12 is a shadow mask 36 containing a plurality of apertures 37 through which the electron beams must pass before reaching the screen 12. First convergence electrodes 38 are arranged between the deflection electrodes 33 and the acceleration mesh 31. These electrodes extend the entire longitudinal dimension of the channels. Arranged between the deflection electrodes 33 and the shadow mask 36 are additional convergence electrodes 39 which also extend the complete longitudinal dimension of the channels. The convergence electrodes 39 are in electrical contact with the shadow mask 36 and therefore are at the same potential as the shadow mask. As explained in Credelle Pat. No. 4,131,823, the convergence electrodes 38 are voltage biased to form a lens transversely across the channels to cause the electron beams 34G, 34R and 34B to converge at a point on the shadow mask 36.

The horizontal scanning of the electron beams 34G, 34R and 34B is affected by applying varying voltages, such as triangular waveforms, to the electrodes **33*a* and 33*b*. The triangular waveforms are applied by the serial connection of two waveform generators 41*a* and 41*b* so that the electrodes 33*a* and 33*b* receive voltages of opposite polarity to affect the horizontal scanning described in the Marlowe et al. U.S. Pat. No. 4,117,368. The waveform generator 41*a* is electrically connected to the deflection electrodes 33 and 33*a* on opposite sides of one of the vanes 19 by the lead 42 so that both of the deflection electrodes are voltage biased with the same voltage simultaneously to avoid charging the capacitor formed on the vane by the deflection electrodes. Tne electrodes 33 and 33*b* are similarly connected by a lead 43 to the generator 41*b*. A voltage source 44, shown in simplified form as a battery, is connected to the convergence electrodes 38 to bias both electrodes with the same level and polarity of voltage. Typically, the convergence voltage is less than the voltage applied to the acceleration mesh 31 and accordingly an electrostatic lens is formed transversely across the channel 21. Because the voltage applied to both the convergence electrodes is the same, the center electron beam 34R is unaffected, while the two outer electron beams 34G and 34B are converged toward the center beam. The three beams therefore converge at points along the transverse line traced by the beams as the deflection voltages on the deflection electrodes 33*a* and 33*b* scan the beams transversely across the channel. This operation is fully described in redelle U.S. Pat. No. 4,131,823. A varying voltage generator 47 is connected between the battery 44 and the convergence electrodes 38 by leads 46. This generator serves to apply a compensation voltage to the convergence electrodes 38 to compensate for horizontal beam landing errors. Details of the horizontal landing error generator 47 are described hereinafter with respect to FIG. 3**.

Figure 4A:
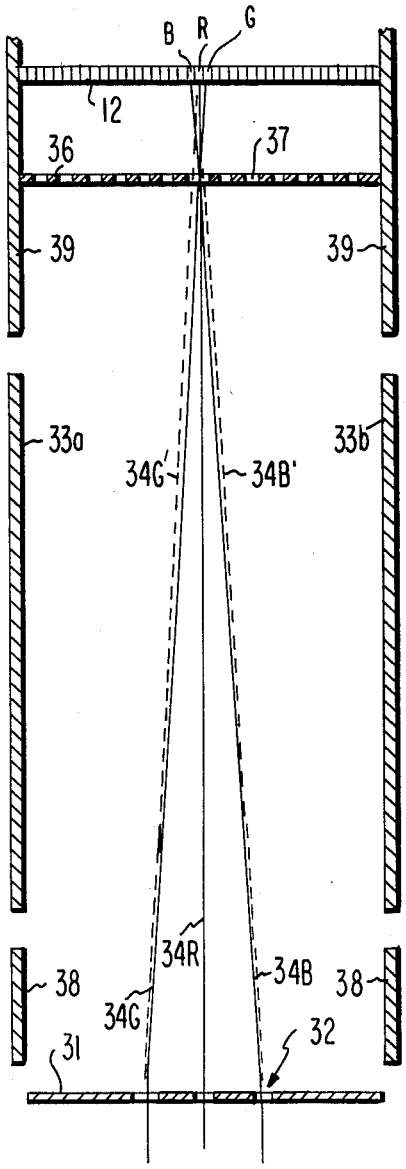
FIGS. 4*a* and 4*b* show how horizontal beam landing errors result in color impurities of the display.

The manner in which horizontal landing errors of the electron beams on the screen 12 cause color impurities is explained with respect to FIGS. **4*a* and 4*b*. FIG. 4*a* is a simplified and enlarged cross section of one channel of the display device. In the absence of horizontal beam landing errors, the three electron beams 34G, 34R and 34B pass through the apertures 32 in the acceleration mesh 31 and the outer beams 34G and 34B are bent by the convergence voltages on the electrodes 38 to converge at the shadow mask 36 and pass through one of the apertures 37. Because the beams converge at the shadow mask, they cross over before striking the screen 12. The beam 34B thus strikes a phosphor which emits blue light and the beam 34G strikes a phosphor which emits green light. The center beam 34R is equally influenced by the convergence voltages on the electrodes 38 and thus is undeflected and travels a straight path through a shadow mask aperture 37 to strike a phosphor which emits red light. The three beams 34G, 34R and 34B** are individually modulated to produce intensities of light from the three phosphors which combine into light of the desired color. This technique is well known in the color kinescope art.

The beams 34G' and 34B', shown in phantom lines, converge between the shadow mask 36 and the screen 12 and thus strike the screen at horizontal landing positions different from the correct positions. The beams can also converge before reaching the shadow mask 36 and strike the screen 12 at erroneous horizontal positions. Either of these conditions can result in one, or both, of the outer beams striking a phosphor of the wrong color. This condition is known in the color television art as color impurity.

Figure 4B:
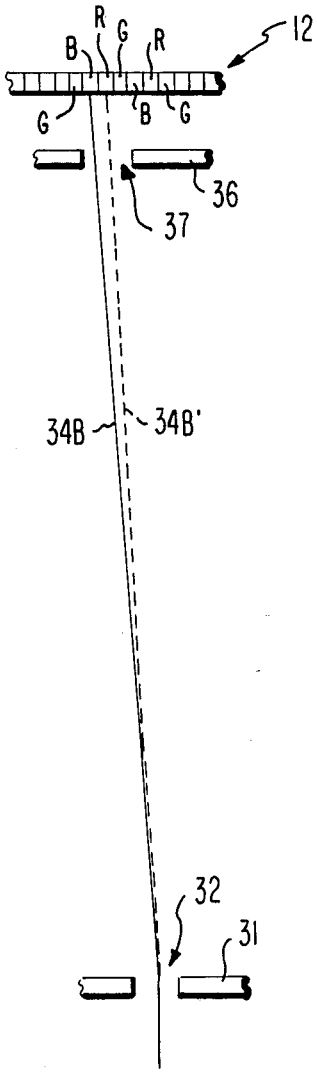

FIG. 4*b* shows how misconvergence results in color impurity. In FIG. 4*b*, the apertures 32 and 37 in the acceleration mesh 31 and shadow mask 36 respectively, are greatly enlarged for illustration purposes. Also, the spacing between the mesh 31 and mask 36 is greatly reduced. The beam 34B is bent at the acceleration mesh 31 and in the absence of a horizontal landing error strikes a phosphor element B which emits the desired blue light. The beam 34B' passes through the shadow mask aperture 37 at too slight an angle and thus is horizontally displaced and the beam strikes a phosphor element R which emits red light. The combined light from the three beams therefore will contain excess red and insufficient blue, a condition known as color impurity. The illustration in FIG. 4*a* shows symmetrical horizontal landing errors for the outer beams 34G' and 34B'. Accordingly, although it is not shown in FIG. 4*b*, the green beam 34G' also would strike a red phosphor element instead of the intended green element and add to the color impurity of the light output.

In instances where the outer beams converge before reaching the shadow mask 36 and pass through the aperture 37 at excessive angles the wrong color phosphor on the other side of the proper element is struck. Thus, in FIG. 4*b* the blue beam 34B' would strike the green phosphor element G which is positioned to the left of the correct blue element B. The horizontal beam landing errors which result in the outer beams striking phosphor elements of the wrong color typically are caused by minor imperfections in the structural components of the flat panel display device and thus are permanent characteristics of each individual display device. Accordingly, actual horizontal landing errors can be measured as a fixed error for each horizontal line traced during the scanning of the electron beams. The landing errors can be translated into known compensation voltages for each horizontal line and the required compensation voltages stored. Subsequently, the compensation voltages are added to or subtracted from the convergence voltages and the electron beams are caused to land at the required positions thereby eliminating or substantially reducing the color impurities which would result from the horizontal landing errors in the absence of the compensation. The measurement of the landing errors can be made using equipment and techniques which are known to those skilled in the television and display tube arts.

Figure 3:
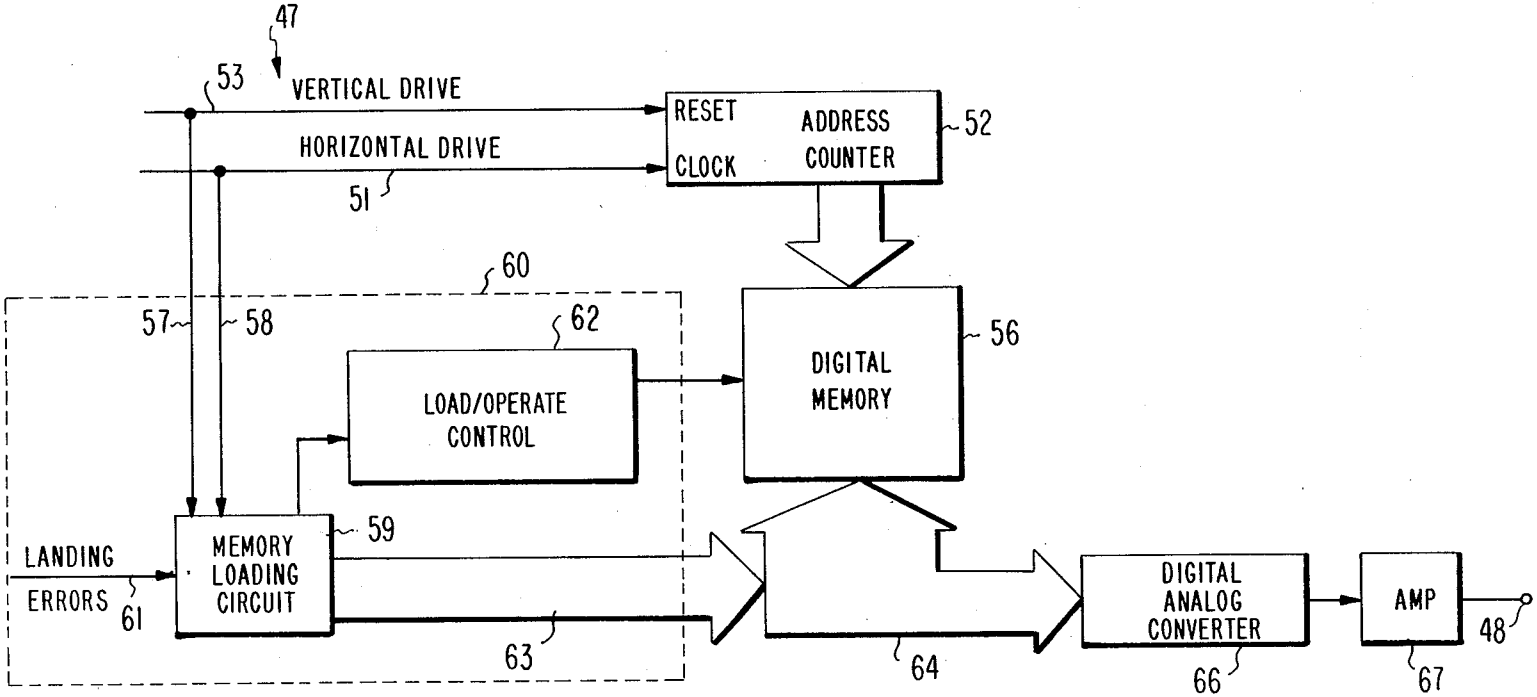
FIG. 3 is a preferred embodiment of a system for adding compensation voltages to the convergence voltages to compensate for horizontal electron beam landing errors.

FIG. 3 is a preferred embodiment of a waveform generator 47 which can be used to generate the horizontal landing error compensation voltages. The horizontal drive voltages which time the horizontal scanning of the channels 21 are received on a line 51 and applied to the clock input of an address counter 52. The vertical drive voltages which initiate extraction of the election beams from between the guide meshes 22 and 23 (FIG. 1) are received on a line 53 and applied to the reset input of the address counter 52.

In the display device 10 (FIG. 1), as the electron beams propagate along the channels 21, the extraction electrode 29 which is furthermost from the cathode 26 is energized and the electron beams travel toward the screen 12 at a vertical position determined by the apertures 27 and 32 in the meshes 22 and 31 respectively. The vertical drive signal on line 53 resets the address counter 52 and the counter commences counting. The horizontal drive signal available on the line 51 clocks the address counter 52 while the deflection voltages are applied to the deflection electrodes 33 of all the channels 21 to scan the beams horizontally across the channels. One complete horizontal line of the display is thus generated. The counter 52 addresses each horizontal line and the total count is equal to the total number of horizontal lines to be scanned. The address counter 52 addresses a digital memory 56, such as a ROM or EPROM, for each horizontal line to be scanned. When the counter 52 times out counting stops until the next vertical drive signal on line 53 resets the counter 52 and initiates extraction for the next field to be displayed. Details of the sequential generation of the horizontal lines are presented in Marlowe et al. U.S. Pat. No. 4,117,368.

The horizontal drive signal on line 51 is coupled by a line 58 to a memory loading circuit 59 contained within a compensation voltage loading system 60. The vertical drive signal on the line 53 is also coupled to the memory loading circuit 59 by a line 57. The measured horizontal beam landing errors for each horizontal spot position are provided by a line 61 as inputs to the memory loading circuit 59. A load/operate control 62 is actuated by the memory loading circuit 59 and is used to set the digital memory 56 in either a load or an operate mode. The output bus 63 of the memory loading circuit 59 is coupled to a bilateral bus 64 which couples the memory 56 to a digital-to-analog converter 66 (D/A). An amplifier 67 receives the output of the D/A and the amplified signal is coupled to junction 48 (FIG. 2) between the waveform generators 41*a* and 41*b*.

In operation, the horizontal and vertical drive signals are applied to the address counter 52, the output of which is applied to the digital memory 56. Accordingly, every horizontal line within the display on the screen 12 is assigned an address in the memory 56. The horizontal and vertical drive signals available on lines 51 and 53 respectively, are also coupled to the memory loading circuit 59 by the lines 58 and 57 respectively. The measured horizontal landing error signals are available on input line 61 and are provided to the memory loading circuit 59, the output bus 63 of which is coupled to the bilateral bus 64. The memory loading circuit 59 actuates the load/operate control 62, the output of which sets the digital memory 56 into either a load mode or an operate mode.

Horizontal beam landing errors are permanently compensated for as a final step before the display device is shipped from the manufacturing factory. The horizontal landing errors are measured using optical/electronic equipment of a type known in the art. These signals are applied to the memory loading circuit 59 and the load/operate control 62 places the digital memory 56 into a load mode. The horizontal landing errors are provided on the output bus 63 of the memory loading circuit 59 and input to the digital memory 56. Accordingly, the measured error signal for each line on the screen 12 (FIG. 1) is permanently stored in the memory 56 as the address counter 52 addresses each line on the screen. After the error signals for every line on the screen are stored in memory, the memory loading circuit 59 switches the load/operate circuit 62 so that the memory 56 is permanently placed into the operate mode. The compensation voltage loading system 60 is a separate system used to load the compensation voltages into the memory 56. The exact nature of the loading system 60 therefore is dependent upon the nature of the memory 56. Accordingly when the memory 56 is a PROM, known PROM loading techniques are used and the loading system 60 is compatitable with PROM loading. Thus, irrespective of the type of memory used, known loading techniques are used and details of the loading are not required herein.

During the generation of a display on the screen 12, the horizontal drive signals are provided to the memory of the Marlowe system in the manner described in the Marlowe patent. The horizontal drive signals also are provided to the address counter 52 so that the digital memory 56 is simultaneously addressed along with the memory of the Marlowe system. The horizontal landing error signals stored in the digital memory 56 are provided by the output bus 64 to the D/A converter 66 and the amplifier 67. The output of the amplifier 67 is coupled to the junction 48 (FIG. 2) so that the convergence voltages applied to the convergence electrodes 38 are modified in accordance with the stored horizontal error voltages. In this manner, the angular approach of the electron beams through the apertures 37 of the shadow mask 36 are compensated and the outer electron beams 34G and 34B are caused to land on the phosphors of the proper colors.

What is claimed is:

1. In a display device which comprises an evacuated envelope having substantially flat, parallel spaced front and back walls and spaced substantially parallel support walls extending between said front and back walls and dividing said envelope into a plurality of channels, means for generating electrons and directing said electrons into said channels as electron beams, beam guide means in each of said channels for propagating said electron beams longitudinally along said channels, means for extracting said electron beams from propagation along said channels toward a phoshor screen on said front wall, deflection means on said support walls for receiving deflection voltages to scan said electron beams transversely across said channels, and converging means for receiving convergence voltages and converging said beams toward points along lines transverse of said channels and spaced from said phosphor screen, an improvement comprising:

means for adding varying compensation voltages to said convergence voltages to compensate for beam landing errors along said transverse lines, said means for adding varying compensation voltages including a digital memory for storing the voltage needed to compensate for each of said landing errors along each of said transverse lines;

said means for adding varying compensation voltages also including means for addressing said digital memory in accordance with the proper transverse landing position of said electron beams on said transverse lines whereby the compensation voltage for each line on said screen is stored in said digital memory;

and also including means for loading said compensation voltages into said memory in synchronization with said addressing of said memory and further including load/operate control means responsive to said means for loading for placing said digital memory in a load mode to load said compensation voltages into said memory and an operate mode after said compensation voltages are loaded.

2. The display device of claim 1 wherein said means for addressing includes counter means.

* * * * *